US008336650B2

(12) United States Patent
Wernicke et al.

(10) Patent No.: US 8,336,650 B2
(45) Date of Patent: Dec. 25, 2012

(54) VEHICLE CRANE WITH A BOGIE AND A SUPERSTRUCTURE

(75) Inventors: Frank Wernicke, Contwig (DE); Jürgen Appel, Contwig (DE); Christian Fuhrmeister, Homburg (DE); Ascan Klein, Kaeshofen (DE)

(73) Assignee: Terex Demag GmbH (DE)

( * ) Notice: Subject to any disclaimer, the term of this patent is extended or adjusted under 35 U.S.C. 154(b) by 398 days.

(21) Appl. No.: 12/532,779

(22) PCT Filed: Mar. 13, 2008

(86) PCT No.: PCT/DE2008/000457

§ 371 (c)(1),
(2), (4) Date: Nov. 3, 2009

(87) PCT Pub. No.: WO2008/116444

PCT Pub. Date: Oct. 2, 2008

(65) Prior Publication Data

US 2010/0051570 A1 Mar. 4, 2010

(30) Foreign Application Priority Data

Mar. 23, 2007 (DE) ..... 10 2007 014 943

(51) Int. Cl.
*B66C 23/00* (2006.01)
*B66C 23/86* (2006.01)

(52) U.S. Cl. ..... 180/53.4; 180/53.1; 212/287

(58) Field of Classification Search ..... 180/53.1, 180/53.4; 212/287–290, 172
See application file for complete search history.

(56) References Cited

U.S. PATENT DOCUMENTS

| | | | | | |
|---|---|---|---|---|---|
| 2,266,651 | A | * | 12/1941 | McLean | 212/172 |
| 2,307,611 | A | * | 1/1943 | De Witt | 414/563 |
| 2,537,755 | A | * | 1/1951 | Harbaugh | 212/287 |
| 2,855,110 | A | * | 10/1958 | Prichard | 212/290 |
| 3,451,560 | A | * | 6/1969 | Witwer | 212/285 |
| 3,599,814 | A | * | 8/1971 | Brownfield | 414/718 |
| 3,628,115 | A | | 12/1971 | Pruitt | |
| 4,202,453 | A | | 5/1980 | Wentworth | |
| 4,336,889 | A | | 6/1982 | McGrew | |
| 4,397,396 | A | * | 8/1983 | Kay et al. | 212/303 |
| 4,705,450 | A | * | 11/1987 | Gano | 414/687 |
| 5,226,497 | A | * | 7/1993 | Beaton | 180/53.4 |
| 5,346,018 | A | * | 9/1994 | Koster | 172/47 |
| 6,308,441 | B1 | * | 10/2001 | Bolitho | 37/411 |
| 2003/0160016 | A1 | * | 8/2003 | Ortiz et al. | 212/300 |

FOREIGN PATENT DOCUMENTS

| | | | |
|---|---|---|---|
| DE | 2027013 | A1 | 12/1970 |
| DE | 3639709 | A1 | 6/1988 |
| DE | 19824319 | A1 | 12/2009 |

OTHER PUBLICATIONS

English Translation of International Preliminary Report on Patentability for International Applicaton No. PCT/DE2008/000457, mailed Oct. 5, 2009, 5 pages.
International Search Report for International Applicaton No. PCT/DE2008/000457, mailed Aug. 5, 2008, 3 pages.

* cited by examiner

*Primary Examiner* — Ruth Ilan
(74) *Attorney, Agent, or Firm* — Cantor Colburn LLP

(57) ABSTRACT

The vehicle crane comprises a truck carrier and a superstructure in which the driving of the superstructure function is carried out by means of hydraulic pumps in the truck carrier, and the hydraulic pumps are driven by a distributor gear unit which is arranged in the truck carrier and to which the output shaft of the vehicle drive is connected.

5 Claims, 3 Drawing Sheets

VEHICLE CRANE WITH A BOGIE AND A SUPERSTRUCTURE

CROSS REFERENCE TO RELATED APPLICATIONS

This is a U.S. national stage of application No. PCT/DE2008/000457, filed on 13 Mar. 2008. Priority is claimed on the following application(s): Country: Germany, Application No.: 10 2007 014 943.5, Filed: 23 Mar. 2007, the content of which is incorporated here by reference.

PRIORITY CLAIM

1. Field of the Invention

The invention is directed to a vehicle crane having a truck carrier and a superstructure.

2. Background of the Invention

Drives of hydraulic pumps are known in cranes, excavators or other construction machinery and utility vehicles. The pumps which are needed for the various work operations are located at auxiliary drives of engines or vehicle transmissions.

Further, emergency steering pumps which are operated by auxiliary gear unit drives or auxiliary drive distributor gear units and which ensure the steering function in the respective vehicle in case of steering failure are also known.

With regard to the power source for the hydraulic pumps, a distinction is made in the field of vehicle cranes between single-engine cranes and dual-engine cranes.

In single-engine cranes, the pumps needed for superstructure operation are driven by the truck carrier engine which is also used for all truck carrier functions.

In dual-engine cranes, the truck carrier engine is responsible for the truck carrier functions and the superstructure engine is responsible for the superstructure functions.

Power takeoffs that have been used up to the present time often have limitations depending on the construction type with respect to the maximum decrease in torque and with respect to gear ratio steps. Further, diverse additional component parts are required for producing the power takeoff function.

SUMMARY OF THE INVENTION

It is an object of the present invention to provide a vehicle crane which is designed as a single-engine crane, wherein the superstructure hydraulic pump drive makes use of the full torque of the drive motor and the gear ratio of the truck carrier transmission.

This object is met according to the present invention by a vehicle crane with a truck carrier and a superstructure in which the driving of the superstructure functions is carried out by means of hydraulic pumps in the truck carrier, and wherein the hydraulic pumps are driven by a transfer case or distributor gear unit which is arranged in the truck carrier and to which the output shaft of the vehicle drive is connected.

The distributor gear unit has a drive position and a neutral position toward the distributor gear unit output and a clutch for engaging and disengaging the pump drive.

The hydraulic pumps are driven for superstructure operation by a power takeoff of the truck carrier distributor gear unit.

The distributor gear unit is driven either by the drive transmission by means of a driveshaft or is flanged directly to the drive transmission. Accordingly, use of the different transmission gear ratios, creates a pump drive which can be varied in speed and torque.

Another improvement is the use of the hydraulic pump arranged at the pump drive as an additional vehicle brake (retarder). This is achieved by means of a correspondingly designed hydraulic circuit with an integrated throttle valve. For this purpose, both power takeoffs must be active in the drive operation of the crane and the pump output must be switched on for vehicle braking.

A number of advantages over known power takeoff solutions are offered by the solution according to the present invention:

- use of a smaller quantity of parts
- reduced weight
- reduced costs
- variable speed and torque for the pump drive
- possibility of increasing pump outputs
- use of the hydraulic pump as an auxiliary vehicle brake (retarder).

DESCRIPTION OF THE PRESENTLY PREFERRED EMBODIMENTS

Figure 1:
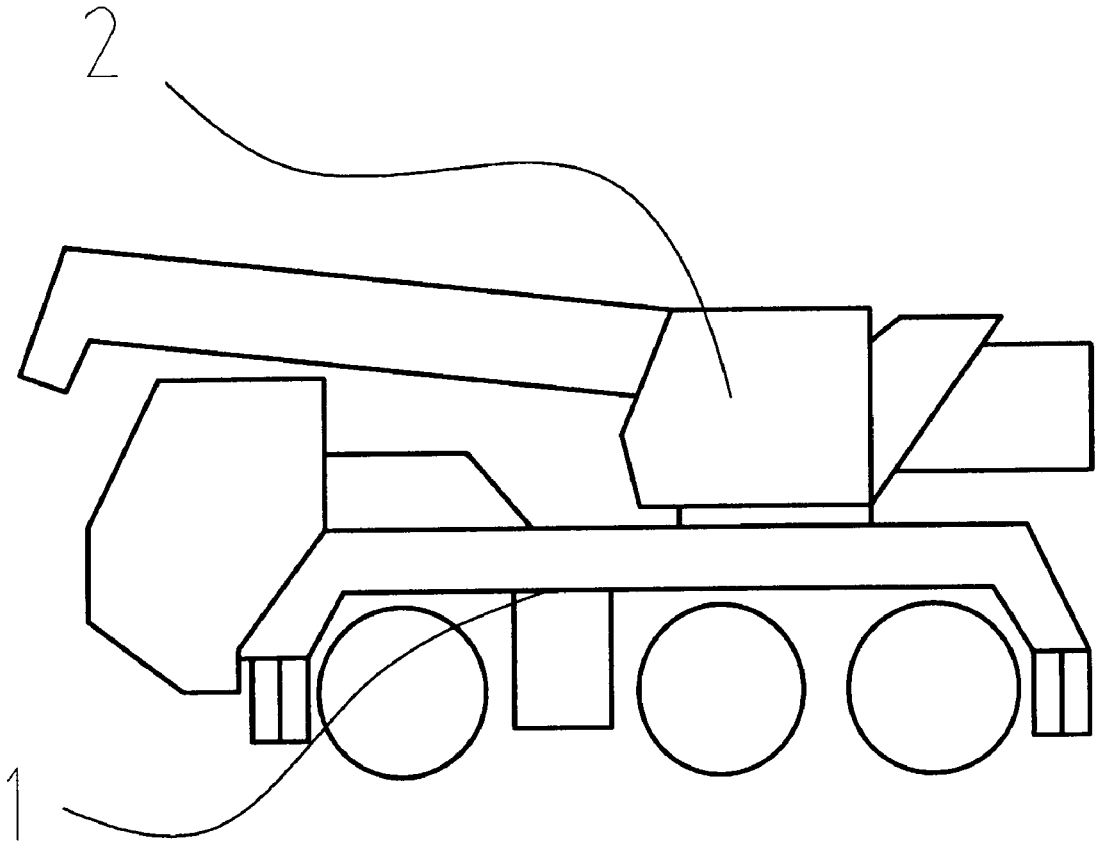
FIG. 1 is a schematic illustration of the vehicle crane of the present invention.
Figure 2:
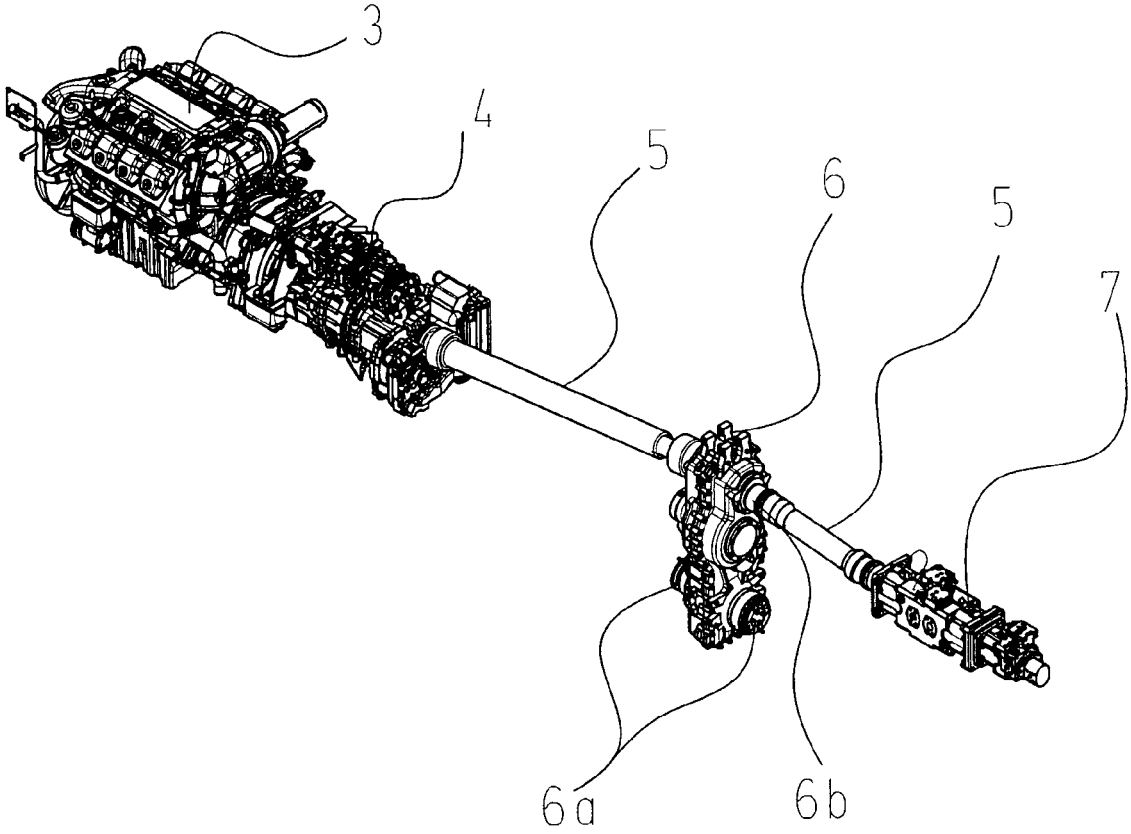
FIG. 2 is a perspective, schematic view of the engine/transmission arrangement of the present invention.
Figure 3:
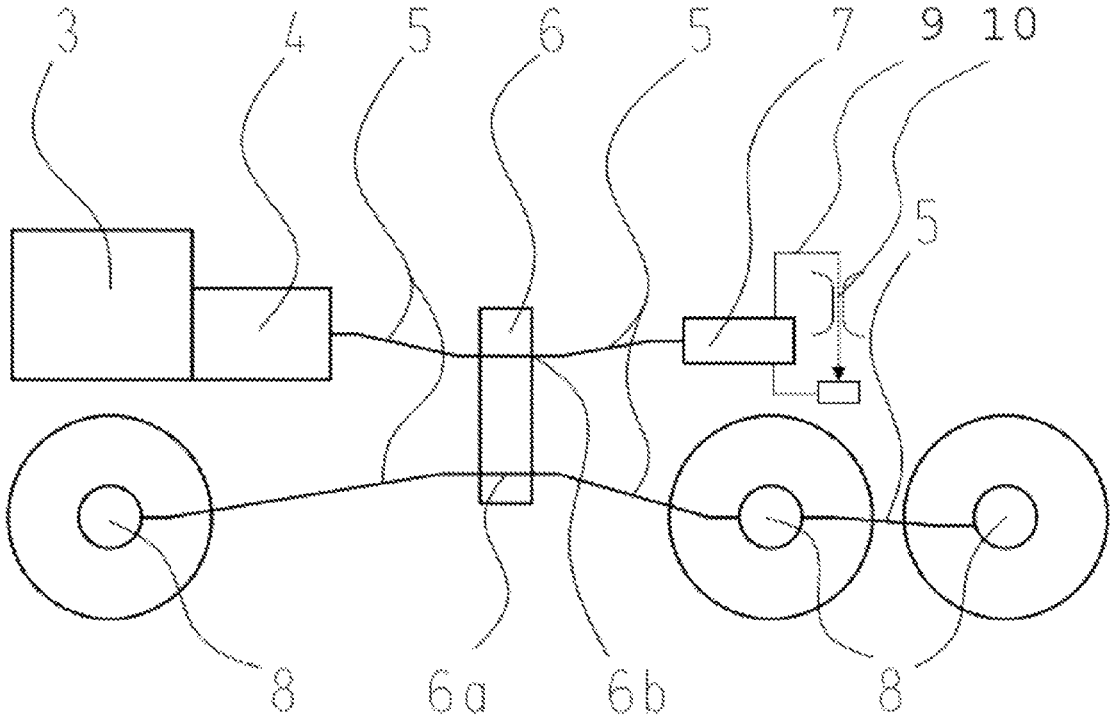
FIG. 3 is a block diagram of the present invention.

Referring more particularly to the drawings, the truck carrier is designated by 1, the superstructure is designated by 2, the truck carrier engine is designated by 3, and the truck carrier transmission is designated by 4.

The truck carrier transmission (4) is connected to the distributor gear unit (6) by a driveshaft (5).

The truck carrier engine (3) drives the hydraulic pumps (7) for superstructure operation by means of the truck carrier transmission (4) and the distributor gear unit (6).

The distributor gear unit (6) has a neutral position toward the distributor gear unit output (6*a*) and a clutch for engaging and disengaging the pump drive (6*b*). The axles (8) are driven by the distributor gear unit power takeoff (6*a*) in drive operation by means of driveshafts (5).

The drive transmission or truck carrier transmission (4) is shifted into $12^{th}$ gear in superstructure operation, and the speed of the engine (3) is limited so that it can be used in a user-friendly, torque-optimized range.

A hydraulic pump (7) arranged at pump drive (6*b*) may be used as an additional vehicle brake (retarder). This is achieved by way of a hydraulic circuit (9) with an integrated throttle valve (10). For this purpose, both power takeoffs must be active in the drive operation of the crane and the pump output must be switched on for vehicle braking.

The invention is not limited by the embodiments described above which are presented as examples only but can be modified in various ways within the scope of protection defined by the appended patent claims.

The invention claimed is:

1. A vehicle crane compromising:

a truck carrier including a vehicle drive, the vehicle drive comprising an engine and a transmission;

a superstructure coupled to said truck carrier;

a distributor gear unit arranged in the truck carrier and coupled to said vehicle drive;

at least one drive axle configured to apply a rotational force to at least one wheel to propel the vehicle crane in a predetermined direction; and a hydraulic pump disposed in the truck carrier configured to selectively drive superstructure functions, the distributor gear unit positioned between said vehicle drive and said at least one drive axle and said hydraulic pump, and configured to selectively transmit torque supplied by the vehicle drive to said at least one drive axle and said hydraulic pump to thereby drive said at least one drive axle and said hydraulic pump.

2. The vehicle crane according to claim 1, the distributor gear unit further comprising a pump drive configured to drive said hydraulic pump and a distributor gear unit output configured to drive said at least one drive axle.

3. The vehicle crane according to claim 1, additionally comprising one or more gear reductions of the vehicle drive for limiting the speed of the engine in superstructure operation.

4. The vehicle crane according to claim 3, wherein in said gear reductions are changeable under load.

5. The vehicle crane according to claim 1, wherein said distributor gear unit is coupled to the vehicle by an output shaft and driven by said vehicle drive via said output shaft.

* * * * *